US010917725B2

(12) United States Patent
Kahfizadeh

(10) Patent No.: US 10,917,725 B2
(45) Date of Patent: Feb. 9, 2021

(54) LOUDSPEAKER MEMBRANE WITH CURVED STRUCTURE PATHS

(71) Applicant: Fibona Acoustics APS, Ballerup (DK)

(72) Inventor: Milad Kahfizadeh, Kgs. Lyngby (DK)

(73) Assignee: Fibona Acoustics Aps, Ballerup (DK)

( * ) Notice: Subject to any disclaimer, the term of this patent is extended or adjusted under 35 U.S.C. 154(b) by 44 days.

(21) Appl. No.: 15/773,095

(22) PCT Filed: Nov. 2, 2016

(86) PCT No.: PCT/DK2016/050353
§ 371 (c)(1),
(2) Date: May 2, 2018

(87) PCT Pub. No.: WO2017/076413
PCT Pub. Date: May 11, 2017

(65) Prior Publication Data

US 2018/0324529 A1 Nov. 8, 2018

(30) Foreign Application Priority Data

Nov. 3, 2015 (EP) ..... 15192690

(51) Int. Cl.
*H04R 1/00* (2006.01)
*H04R 9/06* (2006.01)
(Continued)

(52) U.S. Cl.
CPC ..... *H04R 9/06* (2013.01); *H04R 7/02* (2013.01); *H04R 7/127* (2013.01); *H04R 7/18* (2013.01);
(Continued)

(58) Field of Classification Search
CPC ... H04R 1/24; H04R 7/02; H04R 7/12; H04R 7/127; H04R 7/16; H04R 7/18;
(Continued)

(56) References Cited

U.S. PATENT DOCUMENTS 1,807,225 A 5/1931 Pack
3,152,661 A 10/1964 Wolff
(Continued)

FOREIGN PATENT DOCUMENTS

CN 200966149 Y 10/2007
CN 204616039 U 9/2015
(Continued)

OTHER PUBLICATIONS

International Search Report for International Application No. PCT/DK2016/050353 dated Feb. 20, 2017.
(Continued)

*Primary Examiner* — Katherine A Faley
(74) *Attorney, Agent, or Firm* — Dykema Gossett PLLC

(57) ABSTRACT

An exemplary low-profile loudspeaker can be provided having an enclosure volume defined between a bottom and an outer wall with an outer periphery configured to suspend such membrane in the center, and excite the membrane at the periphery. An exemplary loudspeaker membrane can also be provided with a suspension path along which to suspend the membrane in a loudspeaker and with an excitation path along which to excite the membrane to produce sound when suspended and excited. The membrane can have an outward face for radiating sound and opposite an inward face for facing towards a volume of a loudspeaker, the membrane having a plurality of structure paths each single structure path substantially extending between the excitation path and the suspension path and along each individual structure path being non-flush structures to the otherwise flush outward face.

28 Claims, 13 Drawing Sheets

(51) Int. Cl.

| | |
|---|---|
| ***H04R 7/02*** | (2006.01) |
| ***H04R 7/12*** | (2006.01) |
| ***H04R 7/18*** | (2006.01) |
| ***H04R 9/04*** | (2006.01) |
| *H04R 1/24* | (2006.01) |

(52) U.S. Cl.
CPC ..... *H04R 9/043* (2013.01); *H04R 1/24* (2013.01); *H04R 9/063* (2013.01); *H04R 2400/11* (2013.01)

(58) Field of Classification Search
CPC . H04R 9/02; H04R 9/043; H04R 9/06; H04R 9/063; H04R 2207/021; H04R 2400/11
USPC ..... 381/398, 423, 429
See application file for complete search history.

(56) References Cited

U.S. PATENT DOCUMENTS

| | | | | |
|---|---|---|---|---|
| 3,665,124 | A | 5/1972 | Sotome | |
| 4,100,992 | A | 7/1978 | Rehde et al. | |
| 6,516,077 | B1 | 2/2003 | Yamaguchi et al. | |
| 2002/0140260 | A1* | 10/2002 | Osato | A47D 13/102 297/217.4 |
| 2003/0081800 | A1* | 5/2003 | Klasco | H04R 7/04 381/152 |
| 2004/0007420 | A1 | 1/2004 | Takahashi et al. | |
| 2004/0125980 | A1 | 7/2004 | Turnmire | |
| 2005/0238197 | A1 | 10/2005 | Chang | |
| 2006/0090955 | A1 | 5/2006 | Cardas | |
| 2006/0291673 | A1* | 12/2006 | Kitazawa | H04R 9/06 381/117 |
| 2008/0013781 | A1 | 1/2008 | Sagren | |
| 2009/0028376 | A1 | 1/2009 | Saito et al. | |
| 2011/0116677 | A1 | 5/2011 | Wang et al. | |
| 2013/0108085 | A1 | 5/2013 | North | |
| 2013/0266173 | A1 | 10/2013 | Niedermann | |
| 2015/0172819 | A1 | 6/2015 | Wen et al. | |

FOREIGN PATENT DOCUMENTS

| | | | |
|---|---|---|---|
| DE | 4329637 | A1 | 3/1995 |
| EP | 1 278 397 | A2 | 1/2003 |
| EP | 1 615 466 | A2 | 1/2006 |
| EP | 1711031 | A1 | 10/2006 |
| EP | 1737269 | A1 | 12/2006 |
| JP | S5545269 | A | 3/1980 |
| JP | S619098 | A | 1/1986 |
| WO | WO 2008/141785 | A1 | 11/2008 |

OTHER PUBLICATIONS

Danish Search Report for Application No. PA 2016 70091 dated May 3, 2016.
International Preliminary Report on Patentability for International Application No. PCT/DK2016/050353 dated Feb. 22, 2017.
Partial European Search Report for Application No. EP 15 19 2690 dated Apr. 18, 2016.
Danish Search Report for Application No. PA 2015 70710 dated Jan. 19, 2016.

* cited by examiner

Fig. 10A
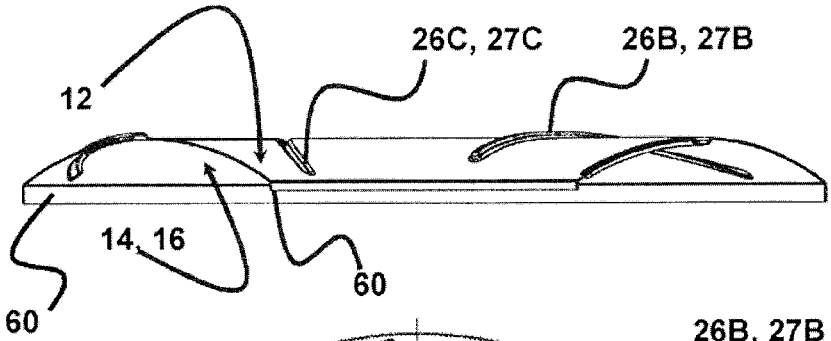
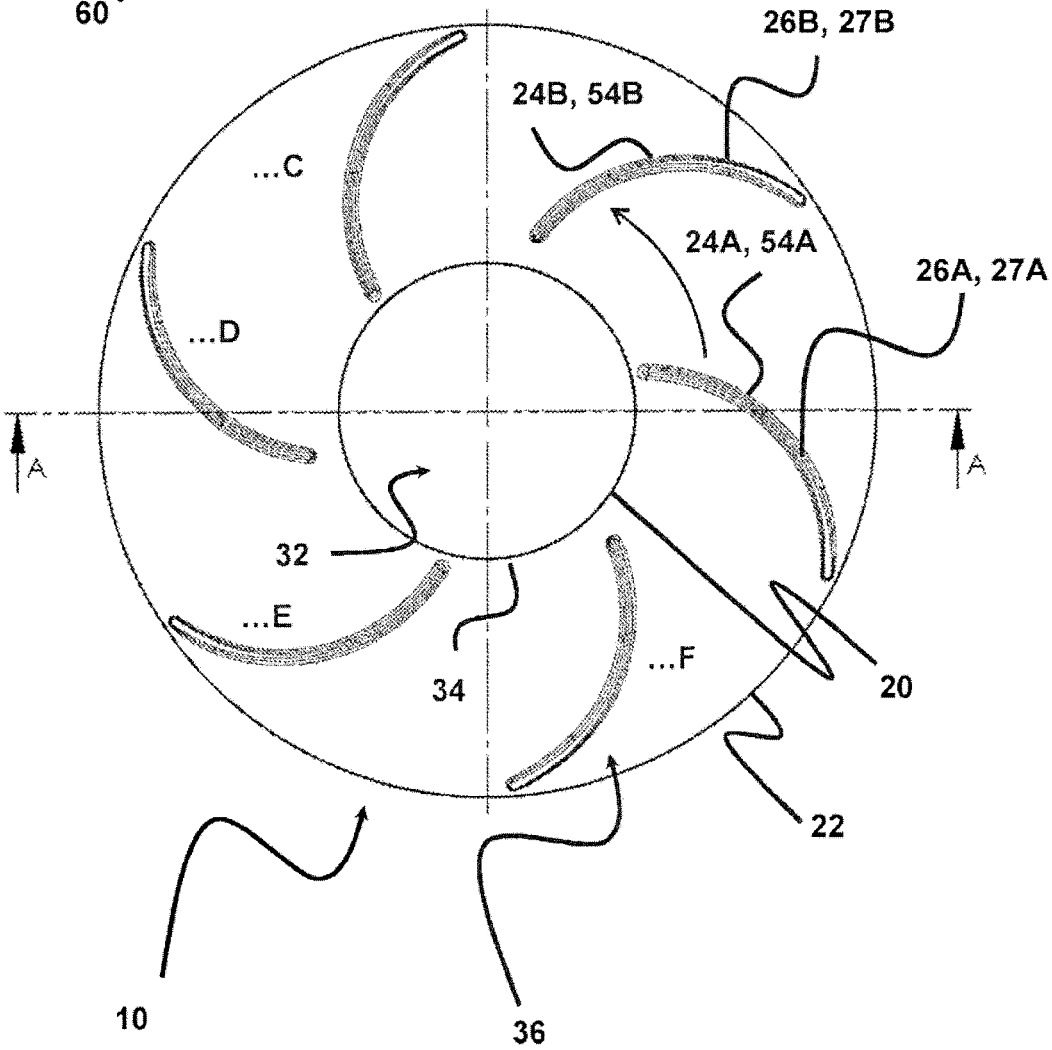
Fig. 10B

LOUDSPEAKER MEMBRANE WITH CURVED STRUCTURE PATHS

CROSS-REFERENCE TO RELATED APPLICATION(S)

The present application is a national phase of International Application No. PCT/DK2016/050353 filed on Nov. 2, 2016, which published as International Patent Publication WO 2017/076413 on May 11, 2017. This application also claims priority from European Patent Application No. 15 192 690.4 filed on Nov. 3, 2015. The entire disclosures of such applications are incorporated herein by reference.

FIELD OF THE DISCLOSURE

The present disclosure relates to a wide frequency range loudspeaker, known as a wide range loudspeaker, where the wide range is in the order of 100 Hz to 10 kHz, optionally extendable in the high frequency range with a tweeter. The present disclosure also relates to wide range loudspeaker membrane, where the wide range is in the order of 50-100 Hz to 10-20 kHz.

The present disclosure also relates a loudspeaker membrane with a suspension path along which to suspend the membrane in a loudspeaker and with an excitation path along which to excite the membrane to produce sound when suspended and excited, the membrane having an outward face for radiating sound and opposite an inward face for facing towards a volume of a loudspeaker, the membrane having a plurality of structure paths each single structure path substantially extending between the excitation path and the suspension path and along each individual structure path being non-flush structures to the otherwise flush outward face wherein the projection of the suspension path and the excitation path on the outward face are symmetric about a symmetry point or a symmetry line and wherein the projection of the structure paths are asymmetric.

The present disclosure further relates a loudspeaker which can be a low-profile loudspeaker having an enclosure volume defined between a bottom and an outer wall with an outer periphery. The loudspeaker may comprise a magnet cup forming the bottom. The magnet cup may be configured and arranged to support a chassis configured to form a centrally placed inner support with an inner support periphery facing the outer periphery of the outer wall and to form an opening between the inner support periphery and the outer periphery. Along the inner support periphery there may be a suspender to suspend a membrane. The membrane may have an aperture and a shape configured to essentially cover the opening and with a suspension path along which to suspend the membrane via the suspender from the chassis. The membrane has with an excitation path to excite the membrane to produce sound when suspended and excited. The membrane has an outward face for radiating sound and opposite an inward face facing the bottom. The membrane may have a voice coil rigidly connected to the excitation path and extending towards and for magnetic interaction with a pole piece. The pole piece may be configured in the magnet cup and to form a pole from a magnet in the magnet cup.

BACKGROUND INFORMATION

Loudspeakers have undergone a century of development, but room for improvements under constraints are still needed.

In particular spatial constraints combined with sound quality characteristics demand novel concepts. Also integration in units and stand-alone loudspeaker units impose constraints that would otherwise impact sound quality.

Prior art loudspeakers that are compact or shallow can be improved. In particular digital loudspeakers characterized in receiving a digital signal to be transformed to sound.

Modern digital or wirelessly connected loudspeakers may also benefit from prolonged play times when powered by e.g. batteries.

Improved or reasonable sound characteristics may vary in acceptance levels, but generally the scope of the loudspeaker disclosed herein relates to a loudspeaker unit capable of producing an improved, reasonable, or even HI-FI quality frequency spectrum in the frequency range between e.g. 100 Hz to 10 kHz and/or the range between e.g. 100 Hz to 20 kHz.

OBJECTS OF EXEMPLARY EMBODIMENTS

It is an object of the present disclosure to overcome shortcomings of existing loud-speaker designs and/or membrane designs.

It is another object of the present disclosure to provide a design of a membrane and/or loudspeaker that has a desirable frequency response that is generally flat over a wide frequency range and at the same time a low or shallow-profile.

It is yet another object of the present disclosure to provide design aspects that can provide a membrane that is structurally stiff whilst providing desirable vibration and acoustic properties over a wide frequency range to allow for improvements in the design of a loudspeaker.

It is a further object of the present disclosure to provide design aspects of a membrane that can be easily manufactured.

SUMMARY OF EXEMPLARY EMBODIMENTS

At least some of the objects of the present disclosure is achieved by an exemplary embodiment of a loudspeaker membrane with a suspension path along which to suspend the membrane in a loudspeaker and with an excitation path along which to excite the membrane to produce sound when suspended and ex-cited, the membrane having an outward face for radiating sound and opposite an in-ward face for facing towards a volume of a loudspeaker, the membrane having a plurality of structure paths each single structure path substantially extending between the excitation path and the suspension path and along each individual structure path being non-flush structures to the otherwise flush outward face wherein the projection of the suspension path and the excitation path on the outward face are symmetric about a symmetry point or a symmetry line and wherein the projection of the structure paths are asymmetric.

The symmetries of the suspension and the excitation paths may be about a common point or a common line.

Such membrane can provide a generally stiff membrane that can be suspended and excited to produce a sound with a wide frequency range whilst the membrane is sensitive and structurally stable so as to produce a high or power output or a power output higher than what is normally produced.

Furthermore the membrane is easy to manufacture.

In particular, the exemplary membrane can reduce or eliminate break-up modes and resonance, thus facilitating a membrane to be used in low-profile loudspeakers whilst maintaining the vibration and acoustic properties of otherwise non-low-profile loudspeakers.

In another exemplary embodiment, each single structure path has the shape of a curve section of one or more curves or approximations thereto and chosen amongst one or more of, e.g.:

a Fibonacci spiral,
a golden spiral,
an Archimedean spiral,
a Euler spiral,
a Fermat's spiral,
a hyperbolic spiral,
a logarithmic spiral,
or combinations thereof.

Structure paths with specific geometries can provide a particularly well suited structural stability providing a membrane capable of functioning over a wide frequency range. Such geometries have been found amongst curve sections of a special class of curves.

The Fibonacci curve can be generated geometrically from a spiral of squares with a side length according to the Fibonacci sequence Fn=Fn-1+Fn-2, with F1=F2=1 or F0=0, F1=1. The Fibonacci spiral may be an approximation of the golden spiral created by drawing circular arcs connecting the opposite corners of squares in the Fibonacci tiling. The squares may have sizes of 1, 1, 2, 3, 5, 8, 13, 21, and 34.

A golden spiral may be generated from a logarithmic formula recited in polar coordinates as $r=ae^{b\theta}$. When θ is in radians, the golden spiral may be for b=0.3063489 . . .

As for the construction of the Euler spiral, Fermat's spiral, hyperbolic spiral or other further details, the person skilled in the art can understand that similar formulas for the respective variants of a logarithmic spiral may be used.

The class of curves can provide asymmetric structures that prevent or reduce resonance modes and to provide additional stiffness to obtain a frequency response over a wide range of frequencies including the range from 100 Hz to 10 kHz.

Furthermore, the class of curves have shown to allow for suspension and/or excitation points or paths that are symmetric which then allow for simple geometries in respect of suspension and excitation thereby allowing for simple design of the suspension and/or excitation means.

When incorporate in the otherwise flush membrane, the structure paths shaped from segments of curves as the Fibonacci spiral or approximations thereto and/or the golden spiral have shown to provide sufficient structural stability to provide strength and stiffness. At the same time, they allow the membrane to be excited and to provide the frequency response according to the intended acoustic design without undesired vibration and/or acoustic disharmonic modes.

In particular, structural paths with the Fibonacci curve or golden spiral can facilitate an excitation of the whole membrane at low frequencies, such as, e.g., about 50-200 Hz or around 100 Hz. At the same time excitation at higher frequencies in the middle region, such as, e.g., 2000-8000 Hz or around 5000 Hz has allowed the essential parts of the membrane to excite without undesired resonances or modes caused by undesired deformation of the membrane. Furthermore at the same time, excitation at high frequencies, such as, e.g., 10 k Hz to 20 k Hz, has allowed parts of the membrane to excite sufficiently to generate sound at the corresponding high frequencies.

In another exemplary embodiment, the membrane is essentially a stiff membrane.

For example, preferably, an exemplary loudspeaker membrane should work as a piston providing the same sound pressure level for all audible frequencies (20 Hz to 20 kHz).

The membrane may be a flat membrane with a typical thickness of less than 1 mm. The thickness may be 0.2-0.3 mm, but also 0.1-0.2 mm.

In a further exemplary embodiment, the membrane can be composed of a metal material. The metal material may be a non-magnetic material such as Al (Aluminium) or Ti (Titanium) or an alloy. The ad-vantage of such materials is that they are easy to form.

In particular, Al can be sufficiently stiff at a thickness of about 0.2 mm and a diameter of e.g. 30 to 200 mm, such as 120 to 160 mm Alternative materials may be or include composite materials. The composite material may be a carbon-based composite material (C). A fibre-rich material may also be used. In an alternative embodiment the membrane is made of a ceramic material.

The membrane material may be reinforced by a coating or by further processing.

For example, the metal may be anodized, which may increase resistance against corrosion and tear and wear. Additionally, anodized surfaces may provide additional strength or stiffness to the membrane.

Anodized aluminium may provide additional advantages in terms of durability since the anodized aluminium prides an additional protective layer.

Anodized aluminium may provide additional corrosion resistance along with additional sealing providing long-term stability by maintaining the same vibration and/or acoustic properties as originally designed for.

Anodized aluminium provides a harder surface than does pure aluminium due to the crystalline structure thereby providing further strength and stiffness to the membrane.

Anodized aluminium can facilitate the membrane to be a front-end surface that can be cleaned and handled and thus eliminates the need for a protective cover of the membrane.

Likewise other metals, including Titanium, may be anodized to achieve similar advantages. Similarly any other materials such as composites may benefit from a coating that is a hardening coating.

A person skilled in the art would understand that other suitable materials and bracing/adonization to obtain a stiffness or strength to sufficiently control/avoid/minimize the effect of resonances without increasing the thickness of the membrane.

In an exemplary embodiment, the loudspeaker membrane further comprises one or more flanges along one or more of the excitation paths or suspension paths. One or more flanges may be essentially perpendicular to the inward face.

A flange may be along the suspension path, along the excitation path, or along both. The flange may provide further stability to the membrane and at the same time an and area to connect suspension arrangement(s) and/or excitation arrangement(s), e.g., a voice coil, to the membrane.

For example, the flange can be of the same material as the membrane.

In another exemplary embodiment, the membrane can be a monolith. This exemplary embodiment can be advantageous in providing a single piece membrane that will react to environmental changes uniformly. This may either be short-term temperature variations or long-term wear-and-tear.

In a further exemplary embodiment, the membrane can have an aperture surrounded by the suspension path and the excitation path.

This exemplary embodiment can define an annularly shaped membrane with an outer perimeter and an aperture perimeter or an inner perimeter. The suspension path may be at the aperture perimeter and the excitation path may be at the outer perimeter. Or the paths may be arranged vice versa.

In yet another exemplary embodiment, the curve origin of the generic curve is placed at the symmetry point, at the periphery of aperture, or at the suspension path and the curve section is, from the curve origin, the first curve section that essentially extends between the suspension path and to the excitation path without crossing the suspension path.

This arrangement of curve sections can provide a sufficient stiffness to the membrane whilst maintaining the lightness and desired acoustic properties of the membrane when suspended and excited. For example, this exemplary arrangement can dampen or eliminate undesired break up modes over a wide range of frequencies when the membrane is suspended and exited.

In a further exemplary embodiment, the excitation path can surround the suspension path.

This exemplary configuration can facilitate the membrane to be suspended centrally and excited at the outer periphery thereby allowing for placing the voice coil at the outer periphery in a loud-speaker.

Furthermore, the exemplary arrangement can control the outer periphery and allows for un-desired modes to be dampened centrally by not having the suspended area or uncontrolled path or periphery at the outer periphery.

According to another exemplary embodiment, the shape of the excitation path can be substantially similar or identical in shape to the shape of the suspension path, but uniformly scaled shape.

This exemplary embodiment facilitates a simple design and layout of the membrane to ease design to achieve specific or desired acoustic properties as ideal properties.

In still a further exemplary embodiment, the excitation path may be in the outer periphery of the membrane. This exemplary configuration may further eliminate free or uncontrolled areas of the membrane and thereby and mitigate undesired break-up modes.

According to yet another exemplary embodiment, the outward face of the membrane can be convex.

This exemplary configuration can facilitate a further stiffening of the membrane as wells as improving the far field characteristics of the sound. For example, when the membrane is excited at the outer periphery, the convex membrane can transmit the mid and higher frequencies outwardly thus improving the far field of mid and high frequency perception of information in this frequency range. Higher frequencies being directive may be directed in a line of sight or with a field profile that is broader than hereto.

This exemplary configuration can facilitate an improved dispersion of high and directive frequency from the edge instead of centrally driven standard drivers or excited membranes. The convex membrane can also give more volume to the enclosure volume and more space to facilitate a spider to be attached advantageously or with a degree of freedom in view of the attachment of a voice coil.

The direction of the non-flush structures may alternate between outward from the outward face and inward from the inward face of the membrane. The distance from an aperture periphery or from the suspension path to the starting point of a single structure path may differ and alternate.

Another exemplary object of the present disclosure can be achieved by a loudspeaker membrane that is annularly shaped with an aperture and with the excitation path at the outer periphery and with the suspension path at the aperture periphery and with a plurality of structure paths extending essentially from the aperture periphery to essentially the outer periphery where each single structure path is formed as a curve section of a Fibonacci curve a golden spiral curve and along each single structure path being non-flush structures that are an embossing in the membrane.

These combined exemplary features provide an overall balanced membrane that shows overall desirable frequency response over a wide range of frequencies ranging from, e.g., 10 Hz to 10 kHz. Such combined features can be provided in a membrane that is easy to manufacture and easy to integrate in a loudspeaker.

In an exemplary embodiment, the embossing can alternate between outward and inward directions in the respective structure paths. The counting may be in the annular direction.

Such exemplary alternation can further dampen undesired modes whilst maintaining the overall stiffness.

According to another exemplary embodiment, the distance from the aperture periphery or from the suspension path to the starting point of a single structure path can be different and alternates. The counting may be in the annular direction.

Thereby further asymmetry is introduced in the membrane without compromising the overall stiffness or strength of the membrane.

A further object of the present disclosure can be achieved by a low-profile loudspeaker having an enclosure volume defined between a bottom and an outer wall with an outer periphery. The exemplary loudspeaker may comprise a magnet cup forming the bottom. The magnet cup may be and arranged to support a chassis configured to faun a centrally placed inner support with an inner support periphery facing the outer periphery of the outer wall and to form an opening between the inner support periphery and the outer periphery. Along the inner support periphery there may be a suspender to suspend a membrane. The membrane may have a shape configured to essentially cover the opening and with a suspension path along which to suspend the membrane via the suspender from the chassis. The membrane has with an excitation path to excite the membrane to produce sound when suspended and excited. The membrane has an outward face for radiating sound and opposite an inward face facing the bottom. The membrane may have a voice coil rigidly connected to the excitation path and extending towards and for magnetic interaction with a pole piece. The pole piece may be configured in the magnet cup and to form a pole from a magnet in the magnet cup.

The membrane may have an aperture. The suspension path may surround such aperture or be essentially along the periphery of such aperture.

The membrane may have the suspension path surrounding the excitation path in the outer periphery of the membrane to freely move relatively to the pole piece as a function of a signal applied to the voice coil.

The membrane may be a substantially stiff membrane.

Thereby a low-profile loudspeaker can be achieved facilitating a particular shallow form factor that can be self-contained and thus eliminates the need for an additional cabinet.

The exemplary arrangement can increase enclosure volume or air volume, which can be otherwise required or preferred to be provided by other ways, such as, e.g., a cabinet, and provides more space, which can facilitate the incorporation of battery-powered digital signal processing and/or amplification. Thus, signals to the loudspeaker can be provided wirelessly.

Such exemplary low-profile loudspeaker can yield a substantially linear frequency spectrum over a wide range of frequencies. The wide range may be the range from 100 Hz to 10 kHz and even 100 Hz to 20 kHz with tweeter integration.

Furthermore, the exemplary arrangement provides for coaxial design and for digital loudspeaker applications.

The exemplary arrangement can furthermore provide a high sensitivity speaker with increased space for power sources such as batteries to increase playtime in wireless configurations.

The exemplary arrangement can also facilitate an integration of the loudspeaker in space limited environments such as automotive settings.

For example, the exemplary arrangement facilitates the loudspeaker to function as a satellite coaxial driver for shallow mounting on-wall, in-wall, in ceiling, even in the frequency range of 100-20 k Hz, since there is no need for additional enclosure when used as a satellite.

The exemplary arrangement can also facilitate the magnet system to be contained in the required enclosure, which is desirable when used as a satellite.

The sensitivity and far field properties of in the mid-range to high-range of frequencies also makes the speaker ideal for conference call devices.

Even thus included the overall exemplary arrangement can facilitate an omission of the tweeter whilst maintain the frequency response between 100 Hz to 10 kHz The exemplary arrangement with the outer peripherally excited membrane can provide more freedom to the magnet design and allows to reduce use of materials/resources and also to minimize cost.

The exemplary arrangement also allows for the suspension, such as a rubber suspension, to function as wave guide for the tweeter.

In an exemplary embodiment, the low-profile loudspeaker can be configured with a membrane con-figured as previously outlined and wherein the chassis and the pole piece are configured complementarily to the membrane to suspend and excite the membrane.

Thus, a person skilled in the art, after reviewing of and obtaining knowledge from the present disclosure, can con-Fig. a chassis and/or pole piece according to the layout of the membrane and achieve the benefits of the wide frequency range of 100 Hz to 10 kHz of the membrane without optional tweeter.

According to another exemplary embodiment, the low-profile loudspeaker may further comprise a tweeter covering a tweeter cavity in the central inner support and being interactively connected to the suspender.

Furthermore, the use of the membrane with the aperture can facilitate inclusion and interaction with a tweeter to achieve benefits in the high frequency range and thus increase the frequency range to about 20 kHz.

According to a further exemplary embodiment, the pole piece may be arranged in the magnetic cup towards the outer wall to form a gap between the outer wall and the pole piece for the voice coil be exited and formed with an radially outward pole face and with a bottom pole face facing the magnetic cup with decreasing extend from the outer wall towards the inner support.

Thereby, the air volume or enclosure volume may further be increased and/or use of sparse magnetic materials may be reduced without compromising the overall functioning of the loudspeaker.

According to yet another exemplary embodiment, the pole piece has a copper cap at the radially outward pole face for facing the voice coil.

The larger area of the outward pole face achieved by the exemplary arrangement of the pole piece for excitement at the outer region gives a larger area and thus reduces the effect of or increases the design options to reduce eddy currents.

The exemplary arrangement provides a larger than otherwise area and allows for electromagnetic coupling between the magnet and the voice coil thus improving the transfer of signals.

According to a still further exemplary embodiment, a permanent magnet can be connected to the pole piece only at the bottom pole face, which thereby reduces the complexity of the magnetic field and provides more space in the housing. The magnet may be a standard magnet or a Neodymium type magnet.

According to yet another exemplary embodiment, the low-profile loudspeaker further can comprise a spider connecting the voice coil to the chassis, preferably to an outwardly extending part of the chassis.

The spider may provide more stability to the membrane when the membrane is excited, and the area of excitement is counterbalanced and thereby providing a more uniform excitement of the membrane. This is particular advantageous when the membrane is excited at the outer periphery, the spider further mitigates or dampens undesired modes.

The exemplary low-profile loudspeaker may further comprise a diffuser being essentially flat and extending into the enclosure volume and formed to reflect sound waves in the enclosure and to direct sound waves outwardly.

The exemplary arrangement can provide space for a diffuser to be embedded in a loudspeaker in a protective fashion. Part of the increased air volume may thus allow for increased design options of the diffuser to further enhance the near or far field characteristics of the speaker according particular circumstances.

In another exemplary embodiment, the loudspeaker may further comprise a rear housing essentially covering the bottom of the chassis forming a rear chamber and/or configured with one or more electronics chambers and terminals.

The exemplary arrangement can facilitate the rear chamber to be an integral part of the loudspeaker unit without affecting the overall acoustic properties of the speaker and thus allows for electronics including processing electronics and power electronics to be integrated according to circumstances.

The exemplary low-profile loudspeaker has one or more sound canals connecting the enclosure volume and/or the tweeter cavity and/or the rear chamber.

Thus, the rear housing can add further air volume to the loudspeaker.

Another object of the present disclosure can be achieved by an exemplary low-profile loudspeaker, whereas the chassis is configured with an annularly shaped pole piece interacting with and a coaxial circular inner sup-port supporting an annularly shaped membrane as recited previously.

Such exemplary embodiment can provide a balanced low-profile loud-speaker having a frequency response that is generally flat over a wide range of frequencies.

For example, the loudspeaker may have a less than 100 mm, preferably less than 75 mm, and more preferably less than 60 mm and an essentially flat frequency response spectrum in the range of 100 Hz to 10 kHz.

The exemplary loudspeaker may have a coaxial tweeter and a height of less than 100 mm, preferably less than 75 mm, and more preferably less than 60 mm and an essentially flat frequency response spectrum in the range of 100 Hz to 20 kHz.

The height may be as low as 30 mm. The before recited heights are for a diameter of about 100-140 mm, but may be scaled to diameters of about 50-200 mm.

The aspects described above and further aspects, features and advantages of the present disclosure may also be found in the exemplary embodiments which are described in the following with reference to the appended drawings and claims.

BRIEF DESCRIPTION OF THE DRAWINGS

Further objects, features and advantages of the present disclosure will become apparent from the following detailed description taken in conjunction with the accompanying figures showing illustrative embodiments of the present disclosure, in which:

FIGS. 10A and 10B are illustrations of an exemplary embodiment of a membrane with asymmetric structure paths formed as segments of a Fibonacci curve/golden spiral as embossings in an otherwise flush and convex membrane;

Figure 1A:
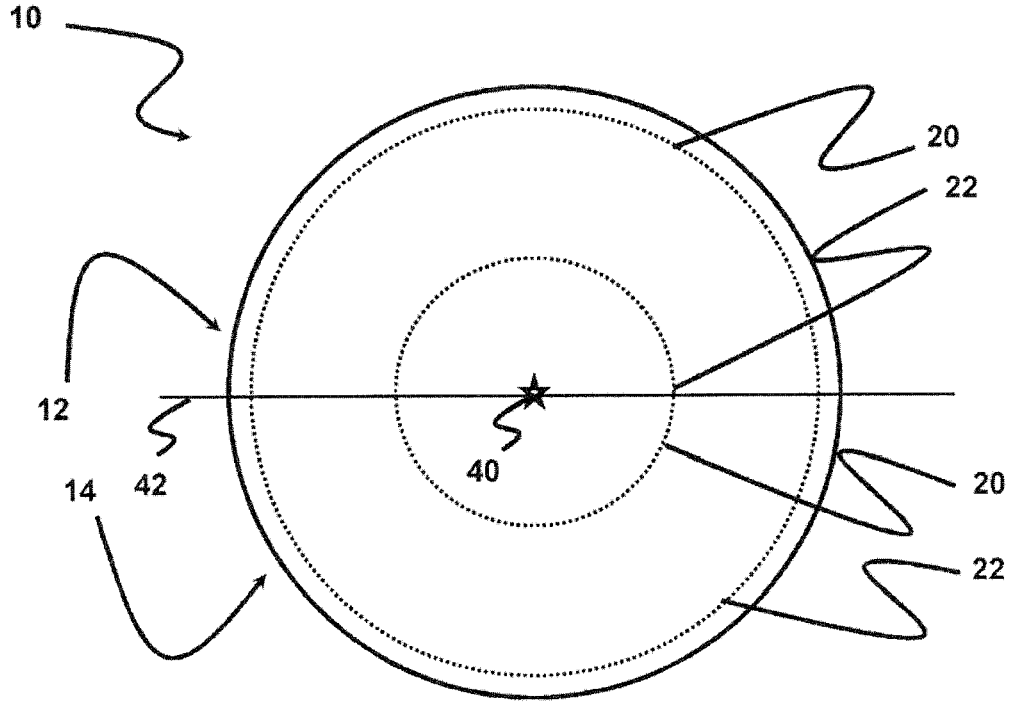
FIGS. 1A and 1B are illustrations of symmetric form shapes of a loudspeaker membrane along with suspension and excitation paths according to certain exemplary embodiments of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure as defined by the appended claims.

DETAILED DESCRIPTION OF EXEMPLARY EMBODIMENTS

Provided below are tables indicating the numerals shown in the drawings, and their associated exemplary meaning, which are not intended to be limiting to such exemplary meaning.

| Item | No |
|---|---|
| Loudspeaker membrane | 10 |
| Outward face | 12 |
| Inward face | 14 |
| Flush face | 16 |
| Suspension path | 20 |
| Excitation path | 22 |
| Structure path | 24 |
| Non-flush structures | 26 |
| Embossing | 27 |
| Outer periphery | 30 |
| Aperture | 32 |
| Aperture periphery | 34 |
| Annular | 36 |
| Symmetry point | 40 |
| Symmetry line | 42 |
| Curve | 50 |
| Curve Origin | 52 |
| Curve form | 53 |
| Curve section | 54 |
| Rotation Angle | 56 |
| Flange | 60 |
| Loudspeaker | 100 |
| Enclosure volume | 102 |
| Bottom | 104 |
| Outer wall | 106 |
| Wall periphery | 108 |
| Gap | 110 |
| Height | 112 |
| Diameter | 114 |
| Magnet cup | 120 |
| Magnet | 122 |
| Chassis | 130 |
| Inner support | 132 |
| Inner support periphery | 133 |
| Suspender | 140 |
| Voice coil | 150 |
| Pole piece | 160 |
| Pole | 162 |
| Outward pole face | 164 |
| Bottom pole face | 165 |
| Copper cap | 166 |
| Tweeter | 170 |
| Tweeter cavity | 172 |
| Spider | 180 |
| Rear housing | 200 |
| Rear chamber | 202 |
| Electronics chamber | 204 |
| Terminals | 206 |
| Sound canal (Cable canal) | 208 |
| Frequency response spectrum | 500 |
| Frequency response spectrum SPL | 510 |
| Frequency response spectrum Tweeter | 520 |

FIG. 1A illustrates an exemplary embodiment of a loudspeaker membrane 10 with a suspension path 20, along which to suspend the membrane 10 in a loudspeaker (not shown) and with an excitation path 22, along which to excite the membrane 10 to produce sound when suspended and excited.

As shown in FIG. 1A, the suspension path 20 may be at the inner region of the membrane 10 and the excitation path may be provided at the outer region of the membrane 10.

The suspension path 20 may be at the outer region of the membrane 10, and the excitation path may be at the inner region of the membrane 10.

The membrane 10 has an outward face 12 for radiating sound and opposite an inward face 14 for facing towards a volume of a loudspeaker (not shown), the membrane 10 has a plurality of structure paths 24, each single structure path 24 substantially extending between the excitation path 22 and the suspension path 20.

The membrane 10 has a symmetry point 40 about which the suspension path 20 is symmetric. The excitation path 22 is symmetric about the symmetry point 40. In this exemplary embodiment, the membrane has a symmetry line 42 about which the suspension path 20 is symmetric. The excitation path 22 is symmetric about the symmetry line 42.

In other exemplary embodiments, e.g., the symmetry may only be about the symmetry line 42.

In the exemplary embodiment as shown in FIG. 1A, the suspension path 20 is a circle and the excitation path 22 is a circle. In this embodiment the suspension path 20 and the excitation path 22 are coaxial circles.

Figure 1B:
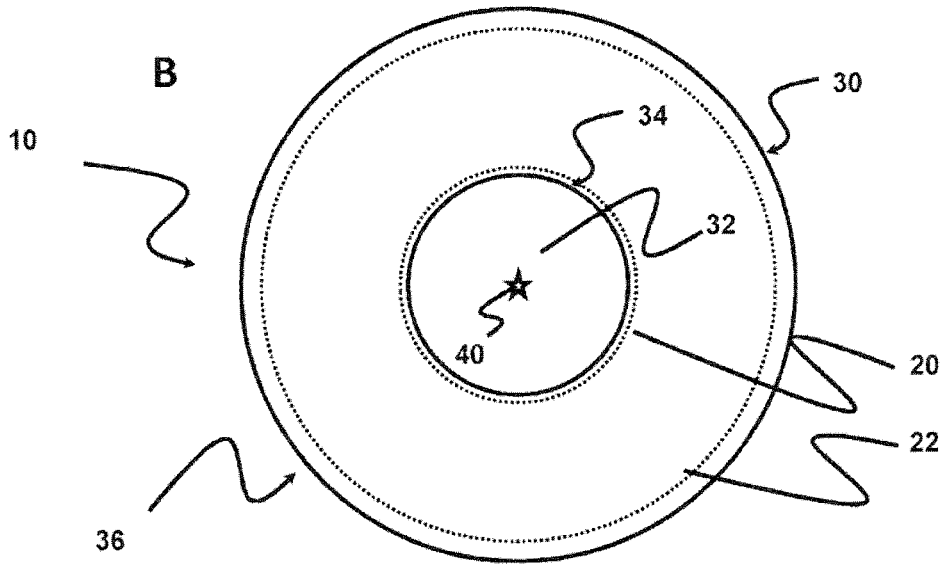

FIG. 1B illustrates an exemplary embodiment of the present disclosure, where a membrane 10 has an aperture 32. In this exemplary embodiment, the aperture is coaxial with a centre at the symmetry point 40. The membrane 10 has a suspension path 20 at or near to an aperture periphery 34 of the aperture 32. The shown embodiment is where the membrane has an annular shape 36 (circular) with an outer periphery 30 and an excitation path 22 close to the outer periphery 30.

For both exemplary embodiments of FIGS. 1A and 1B, the otherwise outward face 12 is generally flash and the symmetries are generally understood as the projection of the suspension path 20 and the excitation path 22 on the outward face 12. The suspension path 20 and the excitation path 22 are symmetric about the common symmetry point 40 or the common symmetry line 42, which may be through the common symmetry point (40) and wherein the projection of the structure paths (24) are asymmetric.

Figures 2A, 2B, 2C, 2D:
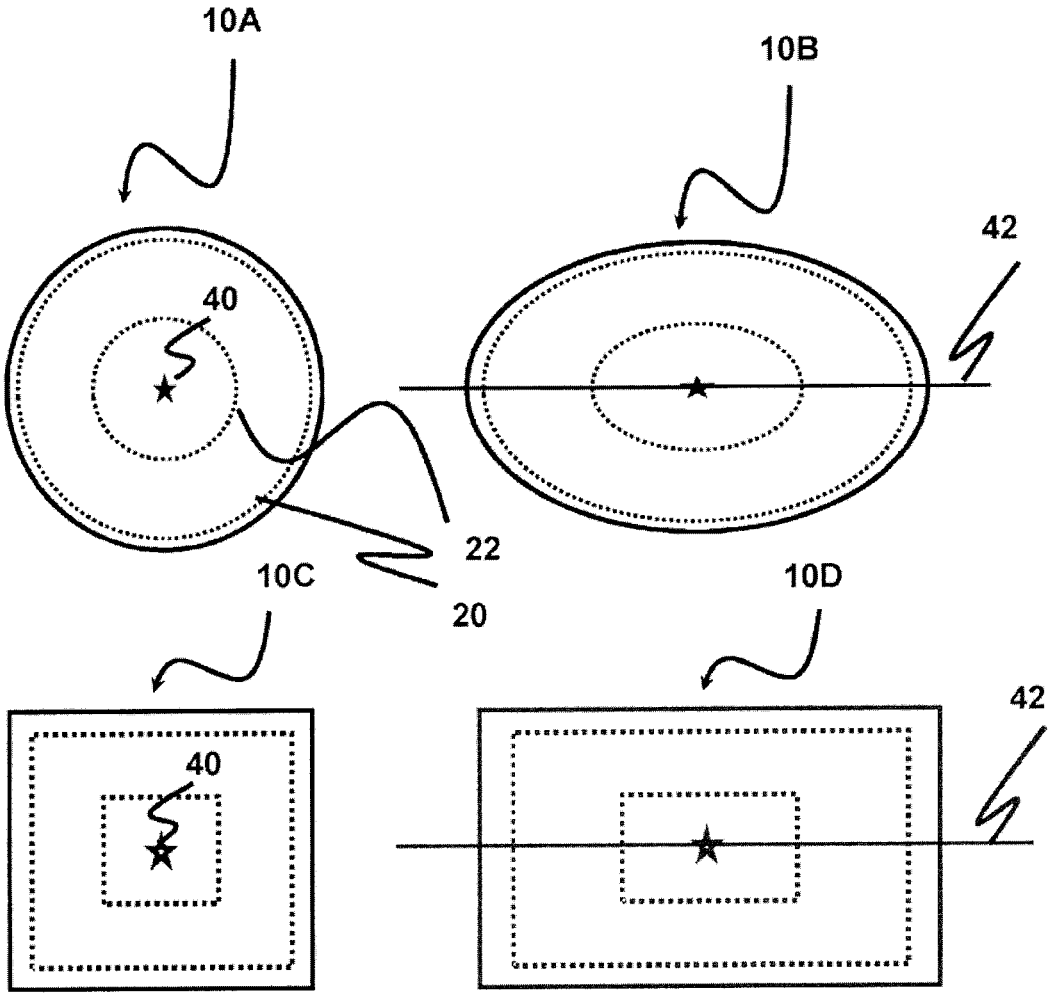
FIGS. 2A-2D are illustrations of further symmetric form shapes of a loudspeaker membrane according to other exemplary embodiments.

FIGS. 2A-2D illustrate exemplary embodiments of membranes 10 having different types of symmetric shapes. FIG. 2A shows a circular membrane 10A shape. FIG. 2B shows an elliptic membrane shape 10B or oval shape. FIG. 2C illustrates a square membrane 10C shape, and FIG. 2D illustrates a rectangular membrane 10D shape.

The exemplary membranes 10A-10D are shown in FIGS. 2A-2D with suspension paths 20 and excitation paths 22 having the symmetric shapes of a circle, an ellipse, a square and a rectangle. The membranes are illustrated without an aperture, and the exemplary embodiments can be provided with a central aperture similar to the exemplary embodiment shown in FIG. 1B.

Figure 3:
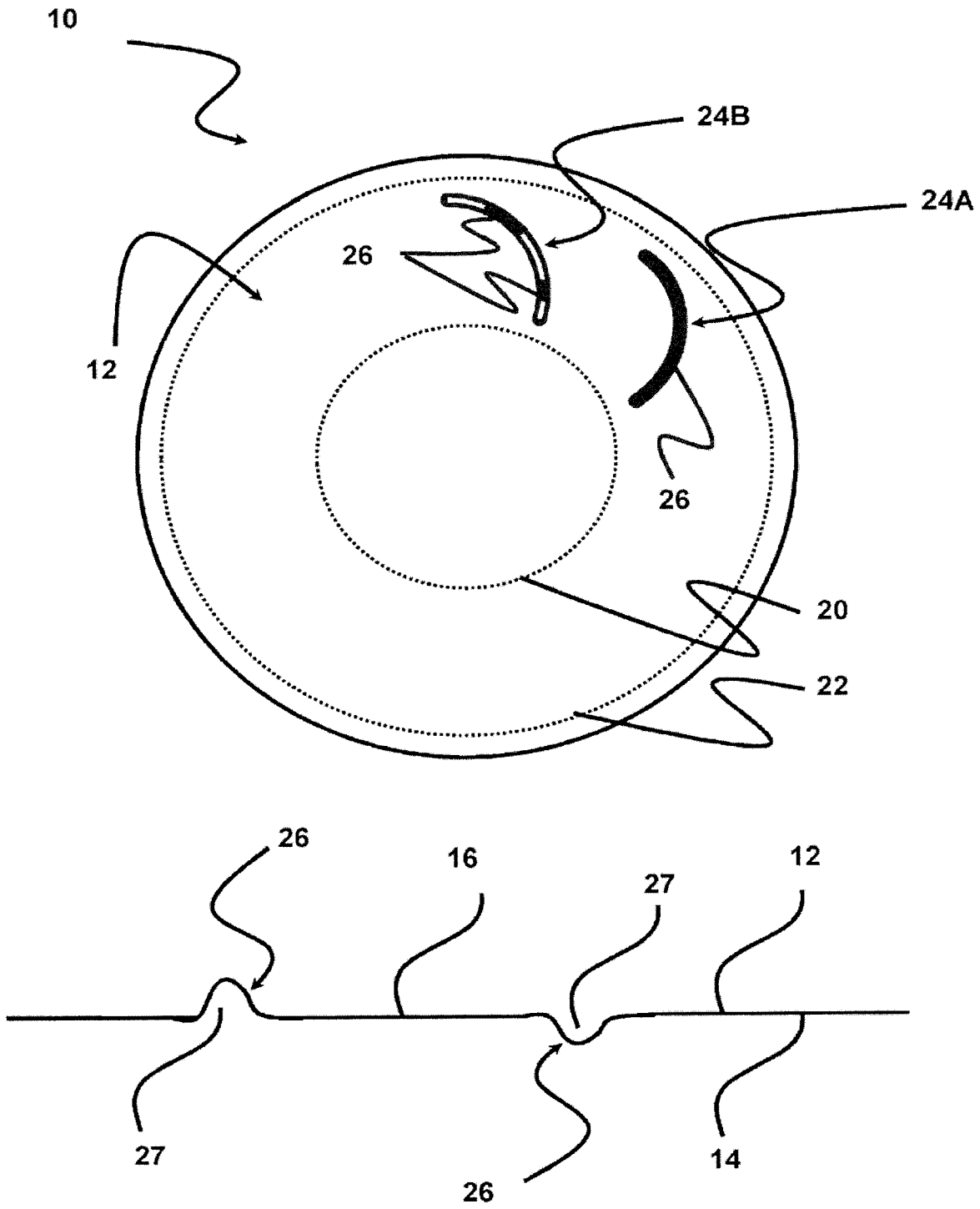
FIG. 3 is an illustration of structure paths and embossing of a membrane.

FIG. 3 is an exemplary embodiment of a membrane from the previous membranes 10 and membranes sharing the stated symmetry properties. In this exemplary embodiment, the shown membrane 10 can be circular and has coaxial suspension path 20 and excitation path 22.

For example, on the outward face 12 of the membrane 10 there are structure paths 24 along which paths there are stiffness-adding structures. Each structure path 24 extends essentially between the suspension path 20 and the excitation path 22. For illustrative purposes, there is a structure extending continuously along the whole structure path 24A and there are multiple disjunct, multiple discrete, structures along a structure path 243. Such exemplary structure paths are asymmetric with respect to the symmetry of the suspension path 20 and the symmetry of the excitation path 22.

In this exemplary embodiment of FIG. 3, and along each individual structure path 24, the structure is a non-flush structure 26 to the otherwise flush outward face 12. The non-flush structures 26 provide stability and stiffness to the membrane 10.

The illustrated individual structure paths 24 and structures such as the non-flush structure 26 may be distributed along each individual structure path 24 being non-flush structures 26 to the otherwise flush outward face 12. It is the projection of the suspension path 20 and the excitation path 22 on the outward face 12 that are symmetric about a common symmetry point 40 or a common symmetry line 42 and wherein the projection of the structure paths 24 are asymmetric.

In each individual structure path 24, e.g., there are non-flush structures 26 such as an embossing 27 in a plate and distributed on the surface of the membrane 10.

Figure 4:
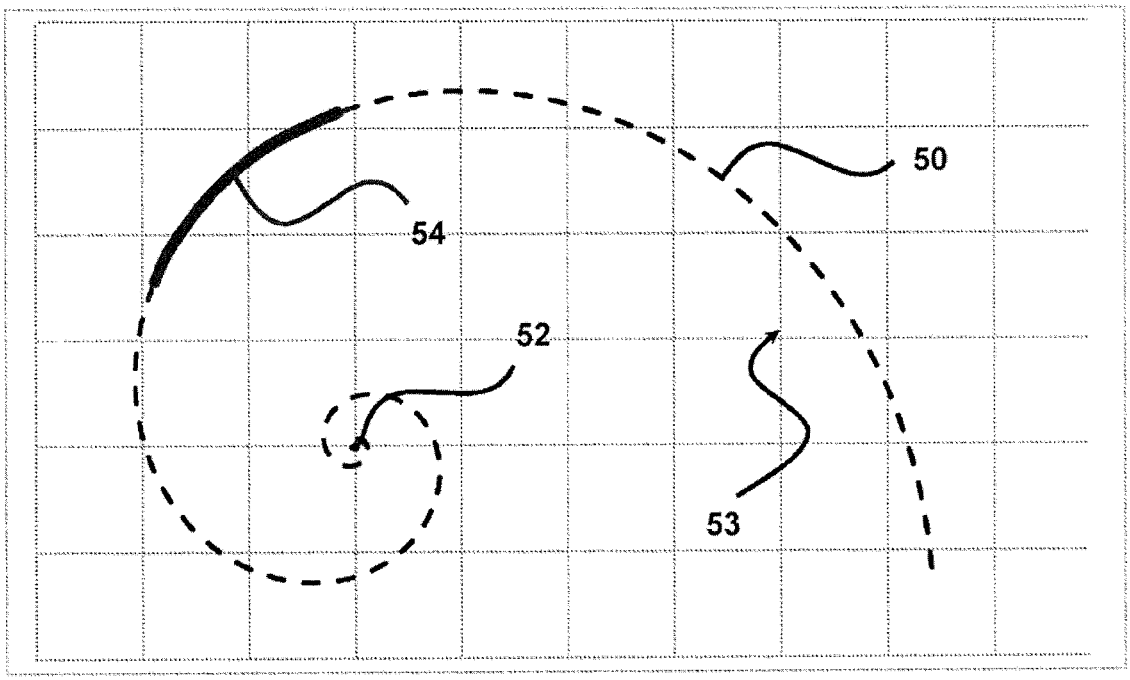
FIG. 4 is an illustration of a generic curve and a curve section to form a structure path that is asymmetric.

FIG. 4 illustrates an exemplary generic curve 50 with a curve origin 52 and a particular curve form 53. Along the curve 50, there is a curve section 54. Such curve 50 may be chosen amongst several curve forms 53 and generated as for example a Fibonacci spiral, a golden spiral, an Archimedean spiral, a Euler spiral, a Fermat's spiral, a hyperbolic spiral, a logarithmic spiral, or combinations thereof.

Figure 5:
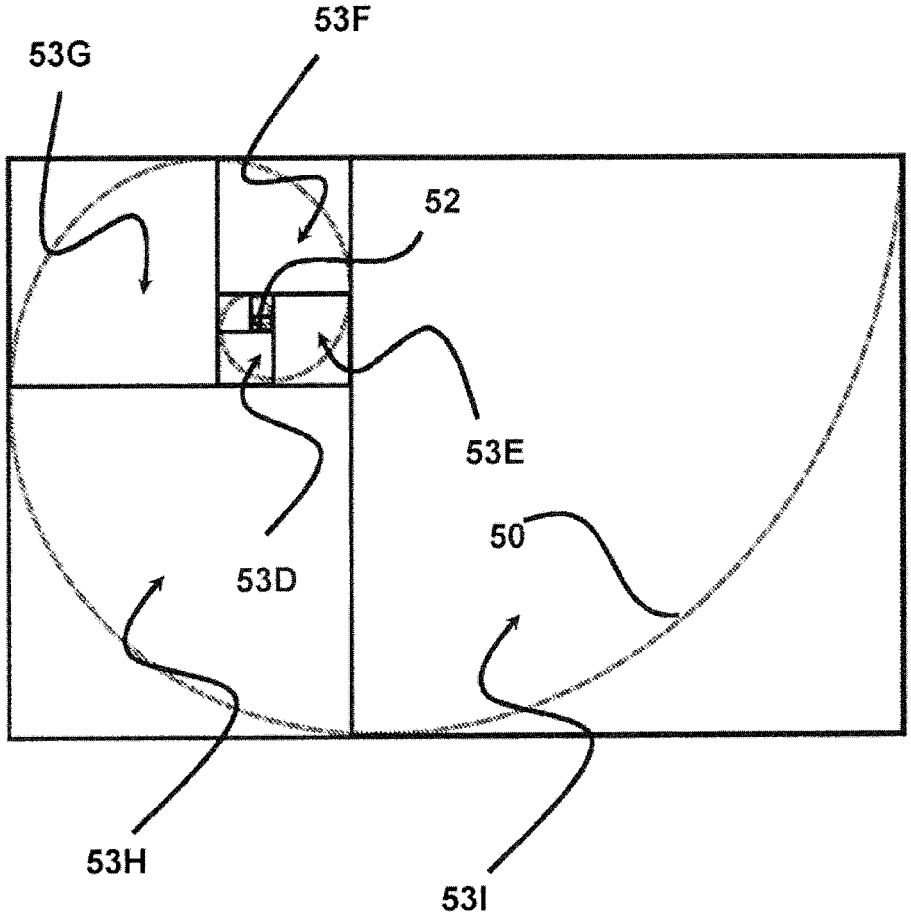
FIG. 5 is an illustration of an exemplary construction of a Fibonacci curve.

FIG. 5 illustrates an exemplary generation of a Fibonacci curve 50 or Fibonacci spiral where the curve firm 53 is generated by squares according to the Fibonacci sequences added in a spiral form from an curve origin 52 so that in this case, the curve form 53 is generated by spiralling squares 53A, 53B, 53C, . . .

The actual curve 50 may be an approximation to the Fibonacci curve form 53 such as the golden spiral.

Figure 6:
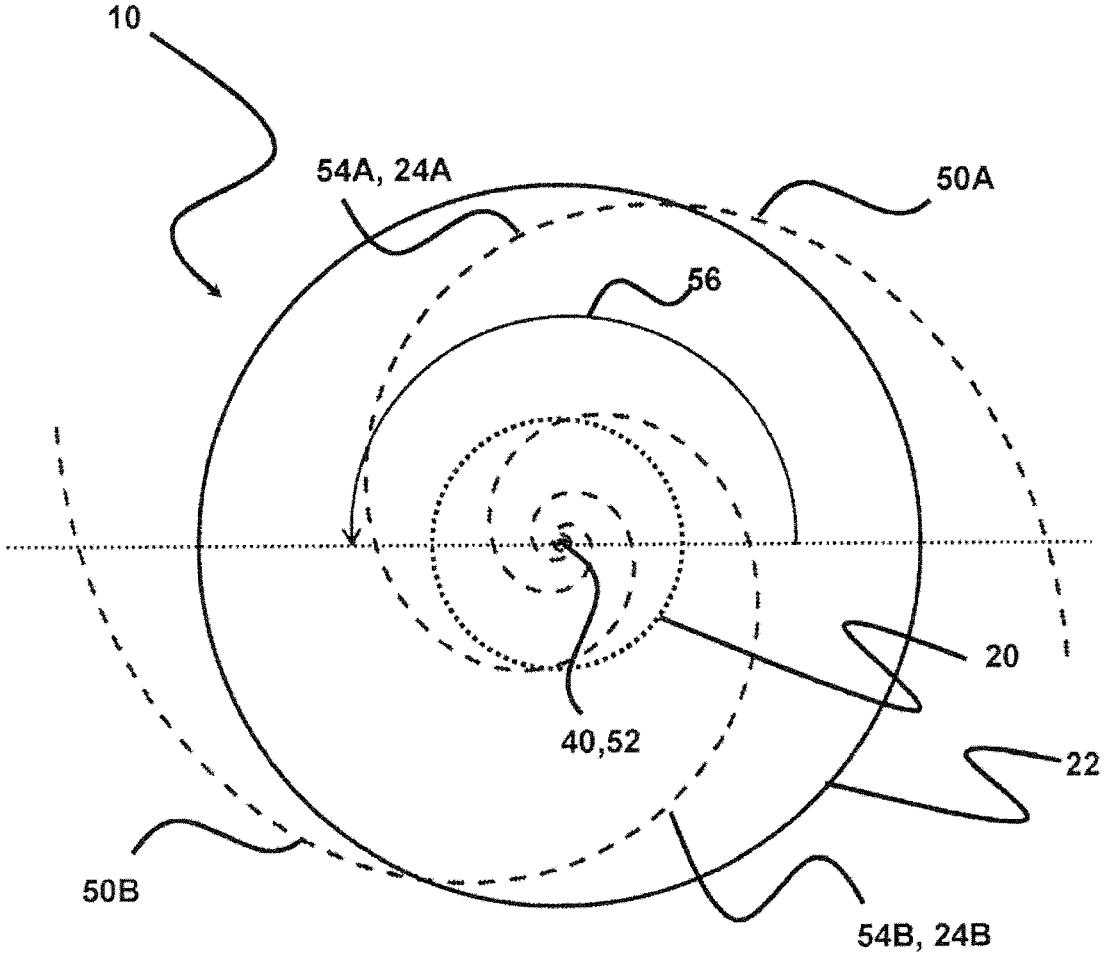
FIG. 6 is an illustration of a membrane with symmetric suspension and excitation paths and structure paths formed by asymmetric curve sections; here sections from a Fibonacci curve.

FIG. 6 illustrates an exemplary membrane 10 with symmetric suspension 20 and excitation 22 paths, where the suspension path 20 is towards the centre and the excitation path 22 at the outer periphery of the membrane 10. The structure paths 24A, 24B can be formed by asymmetric curve sections 54A, 54B. In this exemplary embodiment, the curve sections 54 can be from a Fibonacci curve 50 originating 52 from the symmetry point 40. The structure paths 24 may extend from the suspension path 20 or from the curve origin 52 to or close to the excitation path 22.

Thus, the curve origin 52 of the generic curve 50 is placed at the symmetry point 40 or the periphery of aperture 34 and the curve section 54 is, from the curve origin 52, the first curve section 54 that essentially extends between and without crossing the suspension path 20 and the excitation path 22.

Figure 7:
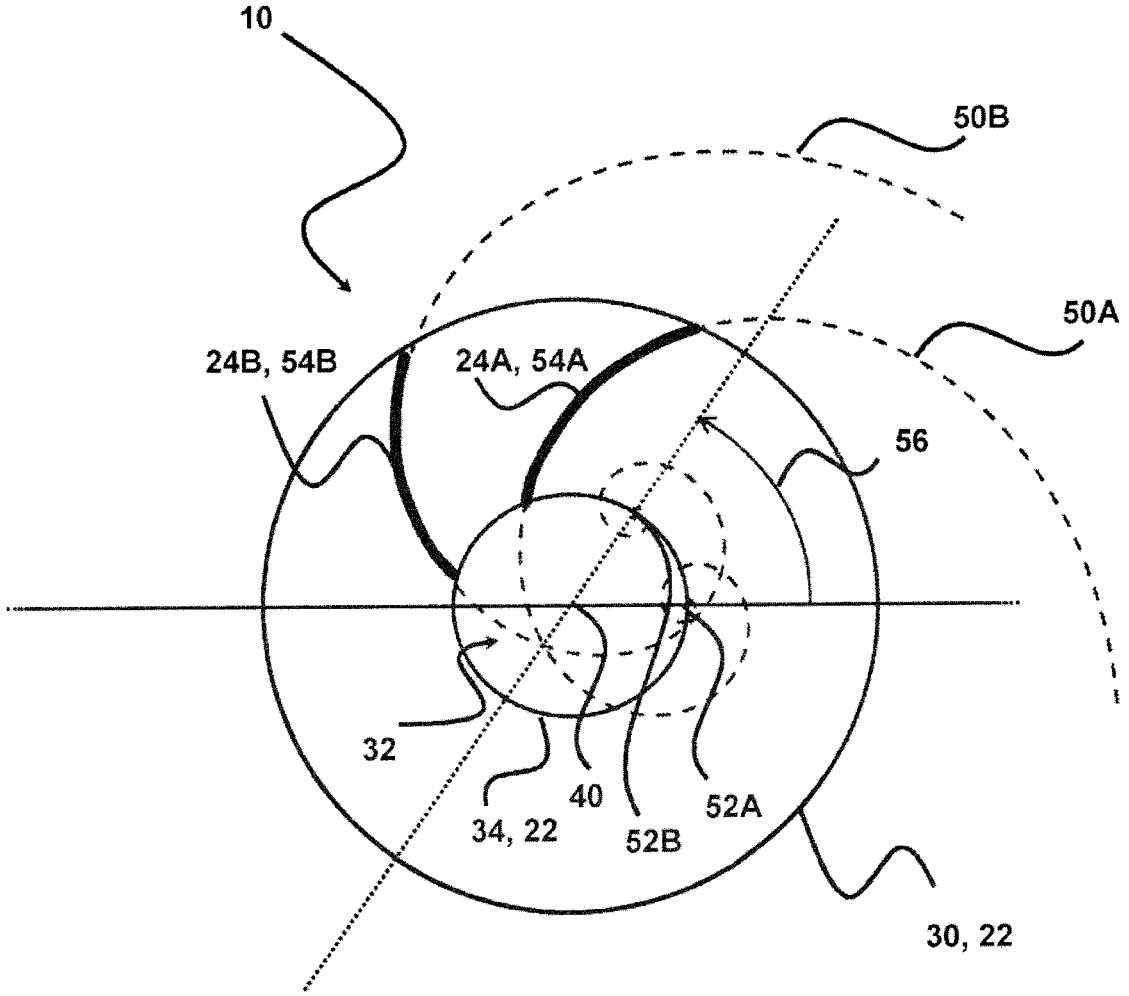
FIG. 7 illustrates an annularly formed membrane with structure paths of curve sections distributed annularly in an asymmetric fashion, the curve sections are sections of a golden spiral/Fibonacci curve.

FIG. 7 illustrates an annularly 36 formed membrane 10 with an aperture 32 having an aperture periphery 34 according to an exemplary embodiment of the present disclosure. The suspension path 20 can be at the aperture periphery 34 the excitation path 22 is at the outer periphery 30 of the membrane 10. The suspension path 20 and the excitation paths 22 are symmetric about the symmetry point 40. Structure paths 24 (A, B, and not shown C, D . . . ) of curve sections 54 (A, B, and not shown C, D, . . . ) are distributed annularly in an asymmetric fashion. The curve sections 54 are sections of a golden spiral/Fibonacci curve 50. The curve sections 54 can be separated or distributed by shifting the curve origin 52 placed on the aperture periphery 34 or suspension path 20 according to an rotation angle 56, which here is 60 degrees.

Figure 8:
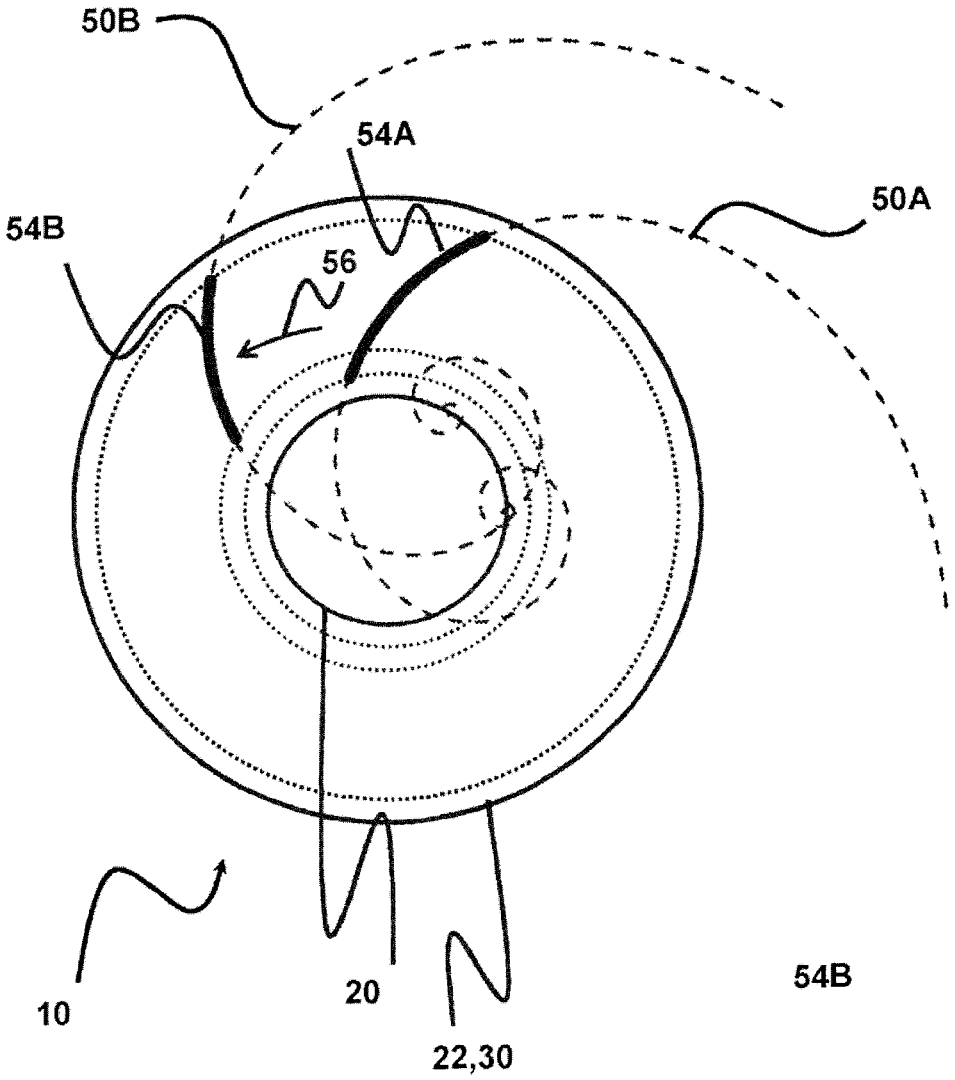
FIG. 8 is an illustration of a further introduction of an asymmetry by varying the extent of the curve sections.

FIG. 8 illustrates in a continuation of the exemplary illustration of FIG. 7, and which provides the introduction of further asymmetry by varying the extent of the curve sections 54. In this exemplary illustration, the curve sections 54 extend only close to the suspension path 20 at the outer periphery 30. Notably curve sections 54 may start from different distances from the suspension path 20. Alternatively, the origin 52 of the curve 50 may be located at different distances from the aperture periphery 34 or suspension path 20. For example, the distance may alternate from one curve section to a subsequent curve section.

Figure 9:
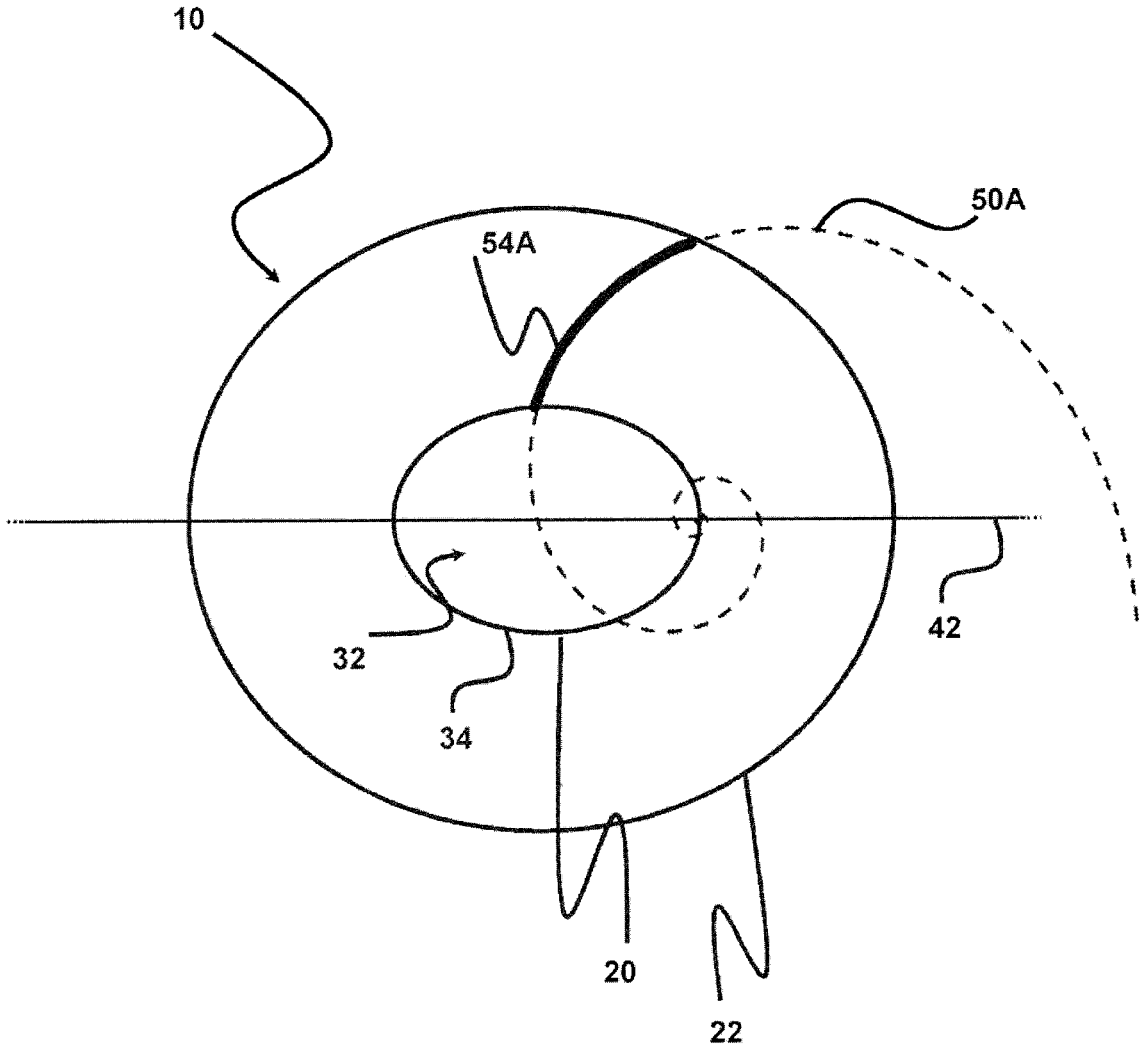
FIG. 9 is an illustration of an elliptic form factor of a membrane with structure paths from curve sections as disclosed.

FIG. 9 illustrates in an exemplary continuation of exemplary illustrations of FIGS. 7 and 8 an elliptic form factor of a membrane 10 and thus a membrane 10 with a symmetry about a symmetry line 42 with structure paths from curve sections 54 that may be generated in line with the previously disclosed principles.

FIGS. 10A and 10B illustrate another exemplary embodiment of a membrane 10 with construction elements in continuation of the exemplary illustrations of FIGS. 7 and 8. In particular, FIG. 10B shows the membrane 10 seen towards the outward face 12 and FIG. 10A shows a cross section (A) of the membrane 10.

In particular, FIGS. 10A and 10B illustrate a circularly symmetrical membrane 10 with a coaxial aperture 32 with an aperture periphery 34. The suspension path 20 is along the aperture periphery 34 and the excitation path 22 is at the outer periphery. The membrane 10 has an annular 36 form. The membrane 10 has a number of non-flush structure 26 distributed on the outward face 12. The non-flush structures 26 are also on the inward face 14.

The non-flush structures 26 are numbered A, and each non-flush structure 26 is an embossing 27 in an otherwise flush face 16 being the outer face 12 or the inner face 14. The embossings 27 forming the non-flush structures 26 alternate outwardly and inwardly as seen on the upper figure. The form of the non-flush structures 26 follows structure paths 24 that are curve sections 54 of a Fibonacci curve/golden spiral.

Furthermore, the starting point of a structure path 24 has an alternating and different distance from the aperture periphery 34.

The aperture periphery 34 has a flange 60, which here is directed inwardly. The outer periphery has a flange 60, which here is directed inwardly.

The membrane 10 may be a monolith and the flange 60 as well as non-flush structures 27 allows for the membrane to essentially have the same thickness between the outer face 12 and the inner face 14.

The form factor of the membrane 10 can be overall convex.

Figure 11:
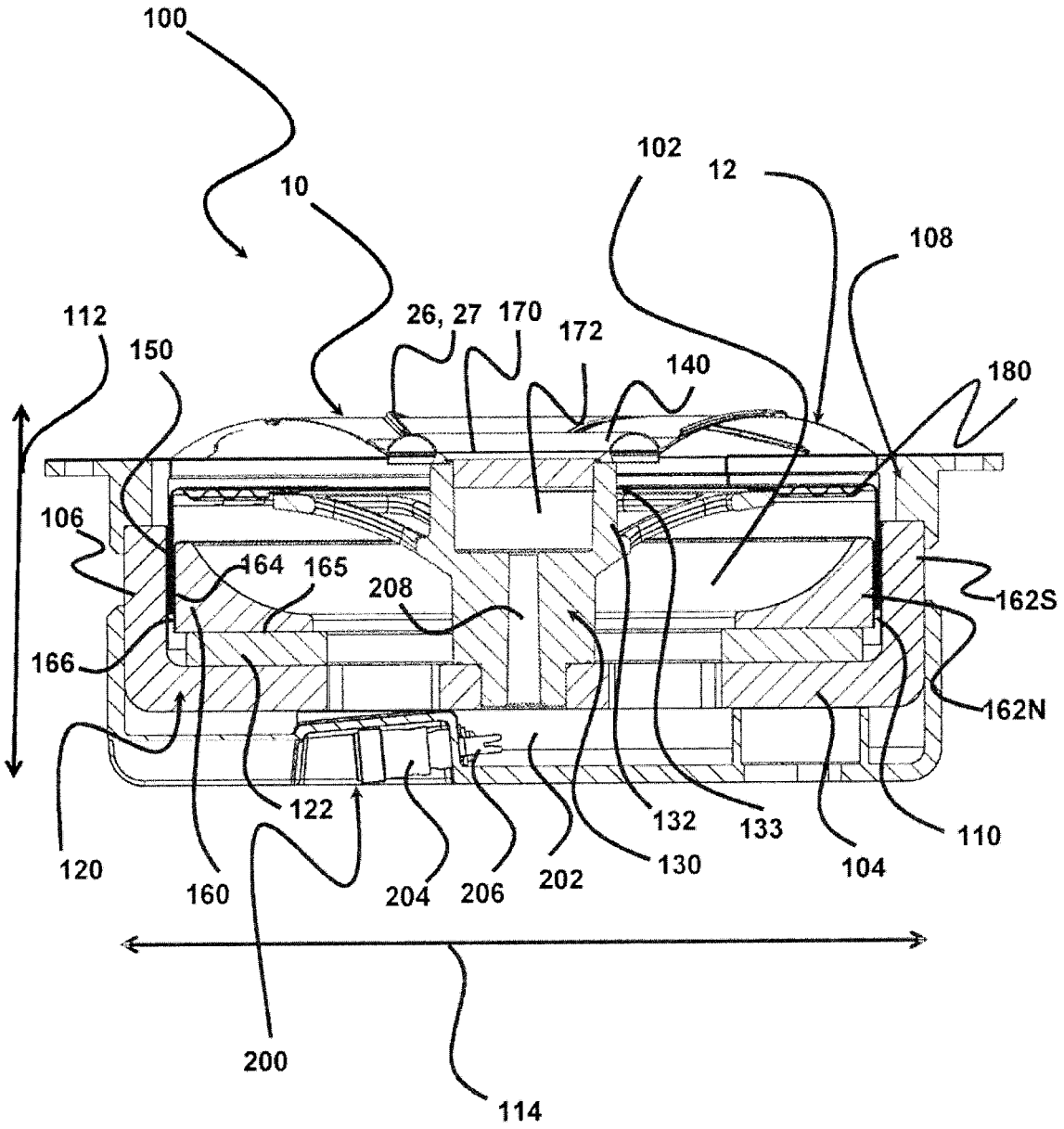
FIG. 11 is an illustration of a cross-sectional view of an exemplary embodiment of a low-profile loudspeaker.

FIG. 11 illustrates a cross-sectional view of a loudspeaker 100 according to another exemplary embodiment being a low-profile loudspeaker 100 having an enclosure volume 102 defined between a bottom section 104 and an outer wall 106 with an wall face 108 facing towards the enclosure volume 102. The exemplary loudspeaker 100 can have a magnet cup 120 forming the bottom 104. The magnetic cup 120 anchors a chassis 130 that forms a centrally placed inner support 132 with an inner support periphery 133 facing the wall face 108 of the outer wall 106 and to form an opening between the inner support periphery 133 and the wall face 108. Along the inner support periphery 133, a suspender (e.g., configuration) 140 can be provided to suspend a membrane 10. The suspension is at an aperture 32 in the membrane 10 along suspension path 20 and via the suspender 140 from the chassis 130.

The membrane 10 can have a shape to essentially cover the opening and an excitation path 22 to excite the membrane 10 to produce sound when suspended and excited.

The membrane 10 has an outward face 12 for radiating sound and opposite an inward face 14 facing the bottom 104. The membrane 10 has a voice coil 150 rigidly connected to the excitation path 22. The voice coil 150 extends for magnetic interaction with a pole piece 160 that is configured in the magnet cup 120. The to form a pole 162 of a pole pair 162N, 162S coming from a magnet 122 in the magnet cup 120.

The pole piece 160 can be arranged in the magnetic cup 120 towards the outer wall 106 so as to form a gap 110 between the outer wall 106 and the pole piece 160 for the voice coil 150 to excite the voice coil 150 attached to the excitation path 22. The pole piece 160 is formed with a radially outward pole face 164 and with a bottom pole face 165 facing the magnetic cup 120. In this case with decreasing extend or height from the outer wall 106 towards the inner support 132.

Furthermore, the pole piece 160 can have a copper cap 166 at the radially outward pole face 164 and for facing the voice coil 150.

For example, the exemplary membrane 10 can have the suspension path 20 at the aperture periphery 34 and the excitation path 22 in the outer periphery 30 of the membrane 10 to move freely relatively to the pole piece 160 as a function of a signal applied to the voice coil 150. The membrane 10 is a substantially stiff membrane 10 and may be of aluminium.

The exemplary membrane 10 of FIG. 11 shares features of the membrane 10 illustrated in FIGS. 10A and 10B and the chassis 130 and the pole piece 160 are configured complementarily to the membrane 10 to suspend and excite the membrane 10; or vice versa.

The exemplary loudspeaker 100 can have a tweeter 170 covering a tweeter cavity 172 in the central inner support 132 and interactively connected to the suspender 140.

The low-profile loudspeaker 100 is characterised in having a low height 112 either absolutely or relative to a diameter 114.

The exemplary loudspeaker 100 can be provided with a rear housing 200 essentially covering the bottom section 104 of the chassis forming a rear chamber 202 and/or configured with one or more electronics chambers 204 and terminals 206.

The rear housing 200 has one or more cable canal or sound canals 208 connecting the enclosure volume 102 with the tweeter cavity 172 and the rear chamber 202.

Figure 12:
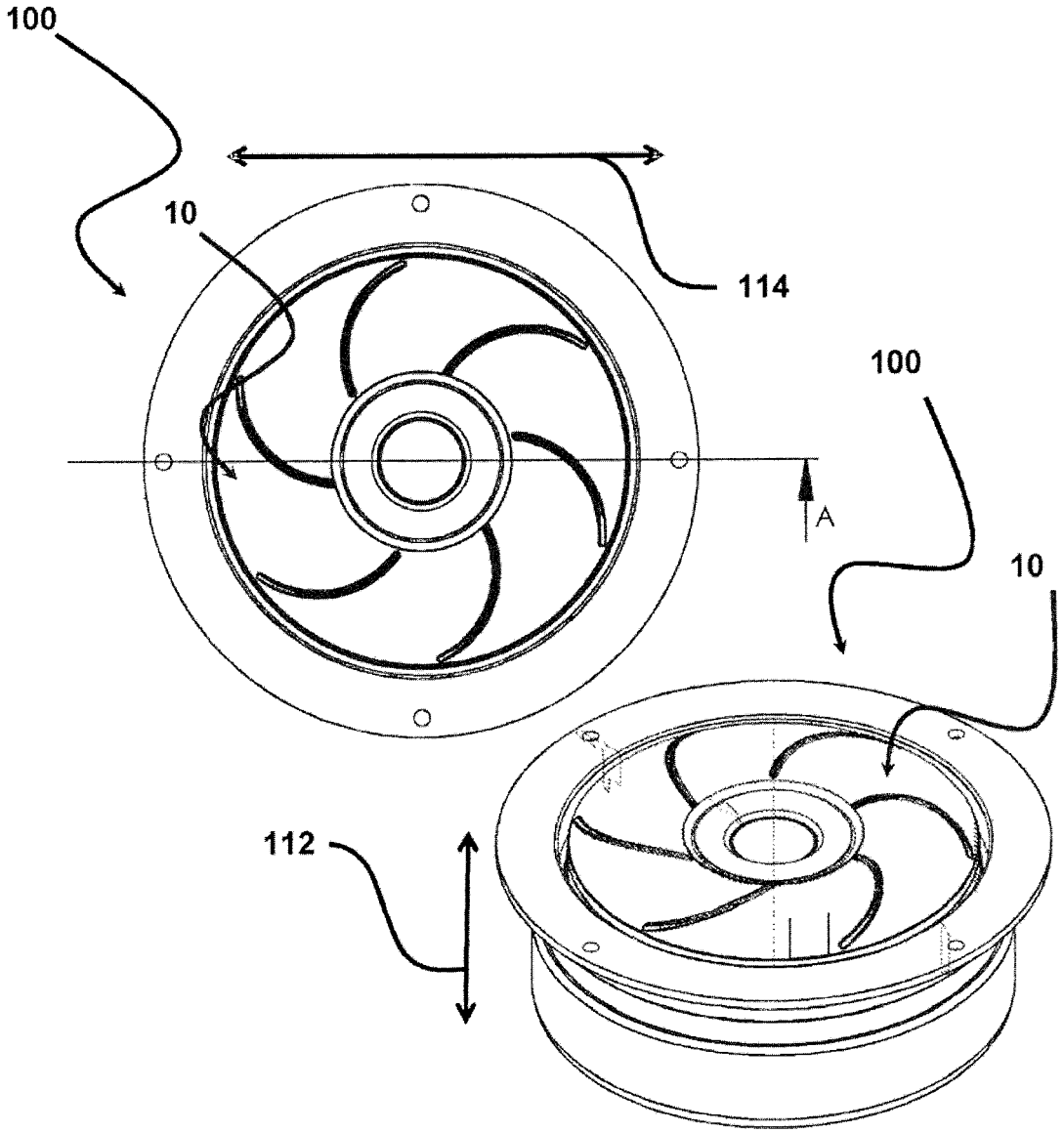
FIG. 12 is an illustration of top and perspective views of the loudspeaker shown in FIG. 11, and with a membrane shown in FIG. 10.

FIG. 12 illustrates perspective views of the exemplary loudspeaker 100 shown in FIG. 11 and the exemplary membrane shown in FIG. 10. The exemplary loudspeaker 100 has a form factor essentially described by a height 112 and a diameter 114 and the loudspeaker is shown to be a unit having a self-containing enclosure and a shallow design with no need of an additional cabinet.

For the exemplary unit shown, the height is 29 mm, approximately 30 mm, and the diameter 88 mm, approximately 90 mm.

Figure 13:
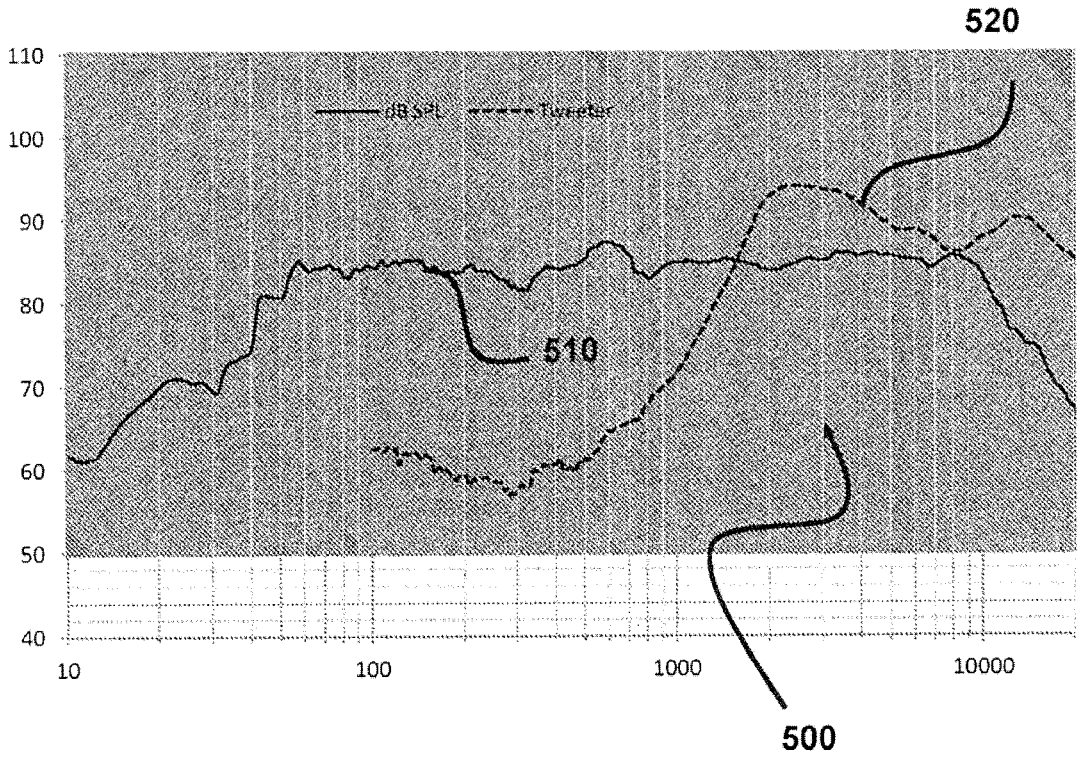
FIG. 13 is an illustration of an exemplary graph of a frequency response of the exemplary low-profile loudspeaker illustrated in FIGS. 11 and 12.

FIG. 13 illustrates an exemplary graph of a frequency response 500 of the low-profile exemplary loudspeaker shown in FIGS. 11 and 12. Frequency response spectrum SPL 510 is seen to be essentially flat from below 100 Hz to about 10 kHz. Frequency response spectrum Tweeter 520 extends the low flatness to about 20 kHz. Thus the overall frequency response is generally flat between 100 Hz and 20 kHz and thus over a wide frequency range.

EXEMPLARY ITEMS

In the following certain exemplary embodiments of an exemplary membrane or an exemplary loudspeaker is described in terms of ITEMS or any combination of ITEMS.

ITEM 1. A loudspeaker membrane (10) with a suspension path (20) along which to suspend the membrane (10) in a loudspeaker and with an excitation path (22) along which to excite the membrane (10) to produce sound when suspended and excited, the membrane (10) having an outward face (12) for radiating sound and opposite an inward face (14) for facing towards a volume of a loudspeaker, the membrane (10) having a plurality of structure paths (24) each single structure path (24) substantially extending between the excitation path (22) and the suspension path (20) and along each individual structure path (24) being non-flush structures (26) to the otherwise flush outward face (12) wherein the projections of the suspension path (20) and the excitation path (22) on the outward face (12) are symmetric about a symmetry point (40) or a symmetry line (42) and wherein the projection of the structure paths (24) are asymmetric.

ITEM 2. The loudspeaker membrane (10) according to ITEM 1, wherein each single structure path (24) has the shape of a curve section (54) of one or more curves (50) or approximations thereto and chosen amongst:

a Fibonacci spiral,
a golden spiral,
an Archimedean spiral,
a Euler spiral,
a Fermat's spiral,
a hyperbolic spiral,
a logarithmic spiral,
or combinations thereof.

ITEM 3. The loudspeaker membrane (10) according to any preceding ITEM, wherein the curve section (54) is divided into subsections.

ITEM 4. The loudspeaker membrane (10) according to any preceding ITEM, wherein the membrane (10) is essentially a stiff membrane (10).

ITEM 5. The loudspeaker membrane (10) according to any preceding ITEM, wherein the membrane (10) is made of a metal.

ITEM 6. The loudspeaker membrane (10) according to any preceding ITEM, further comprising one or more flanges (160) along one or more of the excitation path (22) or suspension path (20).

ITEM 7. The loudspeaker membrane (10) according to any preceding ITEM, wherein the membrane (10) is a monolith.

ITEM 8. The loudspeaker membrane (10) according to any preceding ITEM, the membrane (10) having an aperture (32) surrounded by the suspension path (20) and the excitation path (22).

ITEM 9. The loudspeaker membrane (10) according to ITEM 8, wherein the curve origin (52) of the generic curve (50) is placed at a symmetry point (40) or the periphery of aperture (34) and the curve section (54) is, from the curve origin (52), the first curve section (54) that essentially extends between and without crossing the suspension path (20) and the excitation path (22).

ITEM 10. The loudspeaker membrane (10) according to any preceding ITEM, wherein the excitation path (22) surrounds the suspension path (20).

ITEM 11. The loudspeaker membrane (10) according to any preceding ITEM, wherein the shape of the excitation path (22) substantially is identical in shape to, but a scaled shape of the suspension path (20).

ITEM 12. The loudspeaker membrane (10) according to any preceding ITEM, wherein the excitation path (22) is in the outer periphery (30) of the membrane (10).

ITEM 13. A loudspeaker membrane (10) according to any preceding ITEM, wherein the outward face (12) of the membrane (10) is convex.

ITEM 14. A loudspeaker membrane (10) according to any preceding ITEM, wherein the membrane (10) is annularly shaped with an aperture (32) and with the excitation path (22) at the outer periphery (30) and with the suspension path (20) at the aperture periphery (34) and with a plurality of structure paths (24) extending essentially from the aperture periphery (34) to essentially the outer periphery (30) where each single structure path (24) is formed as curve section (54) of a Fibonacci curve (50) or a golden spiral curve (50) and along each single structure path (24) being non-flush structures (26) that are an embossing (27) in the membrane (10).

ITEM 15. The loudspeaker membrane (10) according to ITEM 14, wherein the direction of the embossing (27) alternates between outward and inward directions in the structure paths (24).

ITEM 16. The loudspeaker membrane (10) according to ITEM 14 or 15, wherein the distance from the aperture periphery (34) or from the suspension path (20) to the starting point of a single structure path (24) is different and alternates.

ITEM 17. The loudspeaker membrane (10) according to any of the ITEMS 14 to 16, wherein the curve section (54) alternates for the structure paths (24) counting radially of the annular (36) shape.

ITEM 18. A low-profile loudspeaker (100) having an enclosure volume (102) defined between a bottom (104) and an outer wall (106) with an wall face (108) and comprising:

a magnet cup (120) forming the bottom (104) and arranged to support a chassis (130) configured to form a centrally placed inner support (132) with an inner support periphery (133) facing the wall face (108) of the outer wall (106) and to form an opening between the inner support periphery (133) and the wall face (108) and along the inner support periphery (133)

a suspender (140) to suspend a membrane (10) with an aperture (32) and a shape configured to essentially cover the opening and with a suspension path (20) to suspend the membrane (10) via the suspender (140) from the chassis (130) and with an excitation path (22) to excite the membrane (10) to produce sound when suspended and excited, the membrane (10) having an outward face (12) for radiating sound and opposite an inward face (14) facing the bottom (104), the membrane (10) having a voice coil (150) rigidly connected to the excitation path (22) and extending towards and for magnetic interaction with a pole piece (160) configured in the magnet cup (120) and to form a pole (162) from a magnet (122) in the magnet cup (120)

wherein the membrane (10) has the suspension path (20) at the aperture periphery (34) and the excitation path (22) in the outer periphery (30) of the membrane (10) to move freely relatively to the pole piece (160) as a function of a signal applied to the voice coil (150) and wherein the membrane (10) is a substantially stiff membrane (10).

ITEM 19. The low-profile loudspeaker (100) according to ITEM 18, wherein the membrane (10) is according to any of the ITEMS 1 to 17 and wherein the chassis (130) and the pole piece (160) are configured complementarily to the membrane (10) to suspend and excite the membrane (10).

ITEM 20. The low-profile loudspeaker (100) according to ITEM 19 further comprising a tweeter (170) covering a tweeter cavity (172) in the central inner support (132) and interactively connected to the suspender (140).

ITEM 21. The low-profile loudspeaker (100) according to any of ITEMS 18 to 20, wherein the pole piece (160) is arranged in the magnetic cup (120) towards the outer wall (106) to form a gap (110) between the outer wall (106) and the pole piece (160) for the voice coil (150) to be excited and formed with a radially outward pole face (164) and with a bottom pole face (165) facing the magnetic cup (120) with decreasing extend from the outer wall (106) towards the inner support (132).

ITEM 22. The low-profile loudspeaker (100) according to any of the ITEMS 18 to 21, wherein the pole piece (160) has a copper cap (166) at the radially outward pole face (164) for facing the voice coil (150).

ITEM 23. The low-profile loudspeaker (100) according to any of the ITEMS 18 to 22, wherein a permanent magnet (122), preferably a Neodymium type magnet, is connected to the pole piece (120) only at the bottom pole face (165).

ITEM 24. The low-profile loudspeaker (100) according to any of the ITEMS 18 to 23, further comprising a spider (180) connecting the voice coil (150) to the chassis (130), preferably to an outwardly extending part of the chassis (130).

ITEM 25. The low-profile loudspeaker (100) according to any of the ITEMS 18 to 24, further comprising a diffuser being essentially flat and extending into the enclosure volume (102) and formed to reflect sound waves and to direct sound waves outwardly.

ITEM 26. The low-profile loudspeaker (100) according to any of the ITEMS 18 to 25, further comprising a rear housing (200) essentially covering the bottom (104) of the chassis forming a rear chamber (202) and/or configured with one or more electronics chambers (204) and terminals (206).

ITEM 27. The low-profile loudspeaker (100) according to any of the ITEMS 18 to 26, where the rear housing (200) has one or more sound canals (208) connecting the enclosure volume (102) and/or the tweeter cavity (172) and/or the rear chamber (202).

ITEM 28. The low-profile loudspeaker (100) according to any of the ITEMS 18 to 27, wherein the loudspeaker (100) is configured with an annularly shaped pole piece (160) interaction with and a coaxial circular inner support (132) supporting an annularly shaped membrane (10) according to any of the ITEMS 14 to 17.

ITEM 29. The low-profile loudspeaker (100) according to any of the ITEMS 18 to 28 wherein the loudspeaker has a height (112) of less than 100 mm, preferably less than 75 mm, and more preferably less than 55 mm and an essentially flat frequency response spectrum (510) in the range of 100 Hz to 10 kHz.

ITEM 30. The low-profile loudspeaker (100) according to any of the ITEMS 18 to 29 wherein the loudspeaker has a height (112) of less than 100 mm, preferably less than 75 mm, and more preferably less than 55 mm and a coaxial tweeter (170) and an essentially flat frequency response spectrum (500) in the range of 100 Hz to 20 kHz.

The invention claimed is:

1. A low-profile wide range loudspeaker having an enclosure volume defined between a bottom section and an outer wall which includes a wall face, comprising:

a magnet cup forming the bottom and arranged to support;

a chassis configured to form (i) a centrally placed inner support with an inner support periphery facing the wall face of the outer wall and (ii) an opening between a periphery of the centrally placed inner support and the wall face; and a suspender configuration along the periphery of the centrally placed inner support; and a substantially stiff membrane having an outer periphery, an aperture with an aperture periphery and a shape configured to essentially cover the opening wherein the membrane includes (i) a suspension path to suspend the membrane via the suspender configuration from the chassis, (ii) an excitation path to excite the membrane to produce sound when suspended and excited, the membrane having an outward face for radiating sound and which is provided opposite to an inward face facing the bottom section, the membrane having a voice coil rigidly connected to the excitation path and extending towards and provided for a magnetic interaction with a pole piece provided in the magnet cup and to form a pole from a magnet in the magnet cup, wherein the membrane has the suspension path at the aperture periphery, and wherein the excitation path is an inwardly directed flange provided at the outer periphery of the membrane and the excitation path is configured and arranged to move freely relatively to the pole piece as a function of a signal applied to the voice coil and to excite the membrane from the outer periphery inward;

wherein the membrane has a plurality of structure paths, each single one of the structure paths substantially extending between the excitation path and the suspension path and each single one of structure paths are non-flush structures compared to the otherwise flush outward face, wherein projections of the suspension path and the excitation path on the outward face are symmetric about a symmetry point or a symmetry line, and wherein a projection of the structure paths are asymmetric relative to one another; and wherein a first structure path of the plurality of structure paths includes a first curved section that is different from a second curved section of a second structure path of the plurality of structure paths.

2. The low-profile wide range loudspeaker according to claim 1, wherein the first curved section of the first structure path has substantially the shape of a first portion of a mathematical spiral, the second curved section of the second structure path has substantially the shape of a second portion of the mathematical spiral, and the shape of the first portion of the mathematical spiral is different from the shape of the second portion of the mathematical spiral.

3. The low-profile wide range loudspeaker according to claim 1, wherein a first distance from the suspension path to a starting point of the first structure path is different from a second distance from the suspension path to a starting point of the second structure path.

4. The low-profile wide range loudspeaker according to claim 1, wherein the first structure path includes an outward embossing relative to the otherwise flush outward face of the membrane, and the second structure path includes an inward embossing relative to the otherwise flush outward face of the membrane.

5. The low-profile wide range loudspeaker according to claim 1, wherein the membrane is annularly shaped with (i) the aperture, and with the excitation path at the outer periphery, (ii) the suspension path at the aperture periphery and (iii) the plurality of structure paths extending essentially from the aperture periphery to essentially the outer periphery, wherein each single one of the structure paths is formed as a curve section of a Fibonacci curve or a golden spiral curve, and wherein the structure paths provide non-flush structures that are an embossing in the membrane; and wherein a dimensional ratio of the loudspeaker is between 1:3 and 2:3, where the dimensional ratio is height: diameter.

6. The low-profile wide range loudspeaker according to claim 1, wherein the plurality of structure paths includes a plurality of the first structure paths and a plurality of the second structure paths that alternate radially about the membrane.

7. The low-profile wide range loudspeaker according to claim 1, wherein the loudspeaker membrane is made of a metal, and the loudspeaker has a height less than 100 mm and a diameter of greater than 100 mm.

8. The low-profile wide range loudspeaker according to claim 1, wherein the loudspeaker membrane is a monolith, and the loudspeaker has a height of 30 mm of less and a diameter of less 90 mm or less.

9. The low-profile wide range loudspeaker according to claim 1, further including a tweeter covering a tweeter cavity in the central inner support and interactively connected to the suspender.

10. The low-profile wide range loudspeaker according to claim 1, wherein the pole piece is arranged in the magnetic cup towards the outer wall to form a gap between the outer wall and the pole piece, wherein the gap causes the voice coil to be excited and formed with a radially out-ward pole face and with a bottom pole face facing the magnetic cup decreasing extending from the outer wall towards the inner support.

11. The low-profile wide range loudspeaker according to claim 1, wherein the pole piece has a copper cap at a radially outward pole face for facing the voice coil.

12. The low-profile wide range loudspeaker according to claim 1, wherein a permanent magnet is connected to the pole piece only at a bottom pole face.

13. The low profile wide range loudspeaker according to claim 12, wherein the permanent magnet is a Neodymium type magnet.

14. The low-profile wide range loudspeaker according to claim 1, further comprising a spider connecting the voice coil to the chassis.

15. The low profile wide range loudspeaker according to claim 14, wherein the spider connects the voice coil to an outwardly extending part of the chassis.

16. The low profile wide range loudspeaker according to claim 1, wherein the membrane is suspended only by the suspender at the inner support periphery.

17. The low-profile wide range loudspeaker according to claim 1, further comprising a rear housing at least one of (i) essentially covering the bottom section of the chassis forming a rear chamber or (ii) configured with one or more electronics chambers and terminals.

18. The low-profile wide range loudspeaker according to claim 17, wherein the rear housing has one or more sound canals connecting at least one of the enclosure volume, a tweeter cavity or the rear chamber.

19. The low-profile wide range loudspeaker according to claim 1, wherein the loudspeaker is configured with an annularly shaped pole piece and a coaxial circular inner support supporting the membrane which is annularly shaped.

20. The low-profile wide range loudspeaker according to claim 1, wherein the loudspeaker has a height of less than 100 mm and a flat frequency response spectrum in the range of 100 Hz to 10 kHz.

21. The low-profile wide-range loudspeaker according to claim 1, wherein the loudspeaker has a height less than 75 mm and includes a coaxial tweeter, and the loudspeaker has a flat frequency response spectrum in the range of 100 Hz to 20 kHz.

22. A wide range loudspeaker membrane adapted to cover an opening of a low-profile loudspeaker, the membrane outwardly having an outward face for radiating sound and opposite and inwardly an inward face for facing towards a volume of a chassis of a loudspeaker, the membrane comprising:

an outer periphery, an aperture with an aperture periphery defining a suspension path along which to suspend the membrane in the loudspeaker and with an excitation path at the outer periphery along which to excite the membrane to produce sound when suspended and excited, wherein the excitation path has a flange extending inwardly for rigidly connecting a voice coil to the excitation path, the membrane having a plurality of structure paths, each single one of the structure paths substantially extending between the excitation path and the suspension path, along each single one of the structure paths non-flush structures are provided to the otherwise flush outward face, wherein projections of the suspension path and the excitation paths on the outward face are symmetric about a symmetry point or a symmetry line, and wherein a first structure path of the plurality of structure paths has the shape of a first portion of a mathematical spiral and a second structure path of the plurality of structure paths has the shape of a second portion of the mathematical spiral, where the first and second portions of the mathematical spiral are different;

wherein, a curve section essentially extends between and without crossing the suspension path and the excitation path, wherein at least one of (i) a curve origin is placed at the symmetry point or (ii) the aperture periphery and the curve section is, from the curve origin; and wherein a first distance from the suspension path to a starting point of the first structure path is different from a second distance from the suspension path to a starting point of the second structure path.

23. The wide range loudspeaker membrane according to claim 22, wherein curve sections of the structure paths are distributed by shifting the curve origin placed on the aperture periphery or the suspension path according to a rotation angle that is about 60 degrees.

24. The wide range loudspeaker membrane according to claim 22, wherein the outward face between suspension path and the excitation path is convex.

25. The wide range loudspeaker membrane according to of claim 22, wherein the membrane is annularly shaped with an aperture, with the excitation path at the outer periphery, with the suspension path at the aperture periphery and with the plurality of structure paths extending essentially from the aperture periphery to essentially the outer periphery, wherein each single one of the structure paths is formed as the curve section of a Fibonacci curve or a golden spiral curve, and along each single one of the structure paths, non-flush structures are provided that are an embossing in the membrane.

26. The wide range loudspeaker membrane according to claim 22, wherein the first structure path includes an outward embossing relative to the otherwise flush outward face of the membrane, and the second structure path includes an inward embossing relative to the otherwise flush outward face of the membrane, and the plurality of structure paths includes a plurality of the first structure paths and a plurality of the second structure paths that alternate radially about the membrane.

27. The wide range loudspeaker membrane according to claim 22, wherein the membrane is made of a metal.

28. The wide range loudspeaker membrane according to claim 22, wherein the membrane is a monolith.

* * * * *